US008567324B1

(12) United States Patent
Paradis et al.

(10) Patent No.: US 8,567,324 B1
(45) Date of Patent: Oct. 29, 2013

(54) FOAM PALLETS AND METHODS FOR CONSTRUCTING

(71) Applicants: Duane Paradis, Highlands Ranch, CO (US); Thomas S. Calzavara, Littleton, CO (US); Shawn Brennan, Cornwall (CA)

(72) Inventors: Duane Paradis, Highlands Ranch, CO (US); Thomas S. Calzavara, Littleton, CO (US); Shawn Brennan, Cornwall (CA)

(73) Assignee: Johns Manville, Denver, CO (US)

( * ) Notice: Subject to any disclaimer, the term of this patent is extended or adjusted under 35 U.S.C. 154(b) by 0 days.

(21) Appl. No.: 13/647,532

(22) Filed: Oct. 9, 2012

(51) Int. Cl.
*B65D 19/00* (2006.01)

(52) U.S. Cl.
USPC ..... 108/51.3; 108/57.25

(58) Field of Classification Search
USPC ..... 108/51.11, 51.3, 57.25, 901, 902
See application file for complete search history.

(56) References Cited

U.S. PATENT DOCUMENTS

| | | | | | |
|---|---|---|---|---|---|
| 2,432,295 | A * | 12/1947 | Donahue | 108/52.1 |
| 3,626,860 | A * | 12/1971 | Blatt | 108/51.3 |
| 3,719,157 | A * | 3/1973 | Arcocha et al. | 108/57.25 |
| 3,861,326 | A * | 1/1975 | Brown | 108/57.29 |
| 4,159,681 | A * | 7/1979 | Vandament | 108/57.33 |
| 4,230,049 | A * | 10/1980 | Horne | 108/57.28 |
| 5,042,397 | A * | 8/1991 | Fiedler | 108/57.18 |
| 5,076,176 | A * | 12/1991 | Clasen | 108/51.3 |
| 5,269,219 | A * | 12/1993 | Juvik-Woods | 108/51.3 |
| 5,687,652 | A * | 11/1997 | Ruma | 108/57.25 |
| 6,705,237 | B2 * | 3/2004 | Moore et al. | 108/57.25 |
| 6,745,703 | B2 * | 6/2004 | Torrey et al. | 108/51.11 |
| 2013/0047897 | A1 * | 2/2013 | Love | 108/51.3 |

* cited by examiner

*Primary Examiner* — Jose V Chen
(74) *Attorney, Agent, or Firm* — Robert D. Touslee

(57) ABSTRACT

The embodiments describe various pallets and methods for constructing such pallets. An exemplary pallet may include a composite board having a foam core and a facer material coupled therewith. The composite board may define a roughly flat top surface that is configured to support one or more goods or other objects placed thereon. A plurality of composite blocks having a foam core and a facer material coupled therewith may be coupled with a bottom surface of the composite board to support the composite board above the ground. The plurality of composite blocks may also be arranged with respect to the bottom surface to allow forks of a fork lift to be positioned under the bottom surface of the composite board so that the pallet may be lifted and/or transported via the forklift.

22 Claims, 4 Drawing Sheets

FOAM PALLETS AND METHODS FOR CONSTRUCTING

BACKGROUND OF THE INVENTION

Pallets are structures that allow various goods or other materials to be transported to various locations. Pallets are commonly made of wood, plastic, or metal and include a flat area or surface upon which the goods or materials are placed. Good or other materials are often stacked and arranged several feet high on top of the pallet. The goods or other materials may be secured atop the pallet using various straps or plastic wraps. For example, goods loaded onto a wooden pallet are often shrink wrapped to contain the goods atop the pallet and to prevent the goods or materials from falling.

Pallets are also typically designed so that a forklift, pallet jack, front loader, or other device can be inserted underneath a top deck of the to allow the pallet to be lifted and transported.

This design allows the pallets to be easily loaded onto a transport vehicle for shipment to various facilities, manufacturing plants, points of sale, and the like. Because of the usefulness of these devices, there is a constant need for improved pallets and methods for constructing such pallets.

BRIEF SUMMARY OF THE INVENTION

Embodiments of the invention describe various pallets and methods for constructing such pallets. According to one aspect, a pallet is described. The pallet may include a composite board having a foam core and a facer material coupled therewith. The composite board may define a roughly flat top surface that is configured to support one or more goods or other objects placed thereon. A plurality of composite blocks having a foam core and a facer material coupled therewith may be coupled with a bottom surface of the composite board to support the composite board above the ground. The plurality of composite blocks may also be arranged with respect to the bottom surface to allow forks of a forklift, pallet jack, front loader, or other device to be positioned under the bottom surface of the composite board so that the pallet may be lifted and/or transported via the forklift.

The composite board may be a top deck of the pallet and the pallet may also include a bottom deck having a foam core and a facer material coupled therewith. The bottom deck may define a top surface and a bottom surface and the plurality of composite blocks may be coupled with the top surface of the bottom deck. The top deck or composite board, and/or the bottom deck, may include a top facer coupled with the top surface and a bottom facer coupled with the bottom surface so that the respective foam core is disposed between the two facer materials. Similarly, one or more of the composite blocks may include both a top facer material and a bottom facer material coupled with a respective top surface and bottom surface of the composite block so that the composite block's foam core is disposed between two facer materials.

According to one embodiment, the foam core of the composite board may have a foam density of between about 2.5 and about 25 pounds per cubic foot and the foam core of the plurality of composite blocks may have a foam density of between about 1.5 and about 2.5 pounds per cubic foot. Additional foam density range values are described herein. The facer material of the composite board or the composite block(s) may include a material selected from: paper, coated paper, foil, fiber mat, coated fiber mat, glass mat, coated glass mat, scrim, and the like.

According to another aspect, a pallet is provided. The pallet may include a foam board that defines a top surface and a bottom surface where the top surface is configured to support one or more goods, materials, or other objects placed thereon. The pallet may also include a plurality of foam blocks that are coupled with the bottom surface of the foam board to support the foam board above the ground when placed thereon. The plurality of foam blocks may also be arranged with respect to the bottom surface to allow forks of a fork lift to be positioned under the foam board so that the pallet may be lifted and/or transported via the forklift. The foam blocks may be stringers, spacers, or blocks. For example, the pallet may include eight or more foam blocks, or include 2 or 3 or more stringers.

According to one embodiment, a facer material may be coupled with the foam board or with one or more of the foam blocks. The foam board may include a foam core, a first facer material coupled with a top surface of the foam core, and a second facer material coupled with a bottom surface of the foam core so that the foam core is disposed between two facer materials. Similarly, a foam block or each foam block may include a foam core, a first facer material coupled with a top surface of the foam core, and a second facer material coupled with a bottom surface of the foam core so that the foam core is disposed between two facer materials.

The foam board may be a top deck of the pallet and the pallet may further include a bottom deck that defines a top surface and a bottom surface. The plurality of foam blocks may be coupled with the top surface of the bottom deck so that the foam blocks are disposed between the top and bottom decks. The bottom deck may include a foam core and a facer material coupled therewith.

According to one embodiment, the top and/or bottom deck foam board(s) have a foam density of between about 2.5 and about 25 pounds per cubic foot and each foam block has a foam density of between about 1.5 and about 2.5 pounds per cubic foot. According to another embodiment, the top and/or bottom deck foam board(s) have a foam density of between about 4.0 and about 7.0 pounds per cubic foot and each foam block has a foam density of between about 1.6 and about 2.0 pounds per cubic foot.

According to another aspect, a method of constructing a pallet is provided. According to one embodiment of the method, a foam board (e.g., a top deck) having or defining a top surface and a bottom surface may be provided. The top surface may be configured to support one or more goods or other objects placed thereon. A plurality of foam blocks may also be provided and a facer material may be coupled with the foam board and/or one or more of the plurality of foam blocks. The plurality of foam blocks may be arranged with respect to the bottom surface of the foam board so that a spacing between adjacent foam blocks is wider than the width of a fork of a fork lift and the plurality of foam blocks may be coupled with the bottom surface of the foam board so that the foam board is supported above the ground when placed thereon.

According to one embodiment, a facer material may be coupled with the top surface and/or the bottom surface of the foam board and an additional facer material may be coupled with a top surface and/or a bottom surface of each foam block. An additional foam board (e.g., a bottom deck) having a top surface and a bottom surface may also be provided and the plurality of foam blocks may be coupled with the top surface of the additional foam board so that the foam blocks are disposed between the two foam boards (e.g., the top and bottom decks). A facer material may also be coupled with the additional foam board (e.g., bottom deck). Coupling the plurality of foam blocks with the foam boards described herein may include using various adhesives and the like.

BRIEF DESCRIPTION OF THE DRAWINGS

The present invention is described in conjunction with the appended figures.

Figure 1:
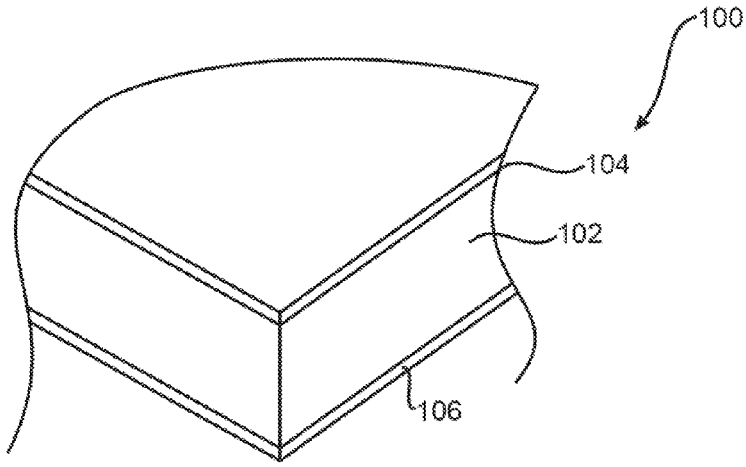
FIG. 1 illustrates a foam board that may be used in the pallets described herein according to an embodiment of the invention.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

Embodiments of the invention describe pallets and methods for constructing such pallets. As commonly known in the art, pallets are devices upon which goods or other objects may be placed for transport and/or storage. Pallets typically provide a relatively flat surface upon which the goods or objects are placed. The use of the word pallet herein is not meant to limit the invention to any one type of such device, but rather encompasses any object or device upon which goods, products, or other objects may be placed.

The pallets described herein include at least one polymer member, such as the top deck, blocks, stringer, and/or bottom deck. In one embodiment, the polymer member is a composite structure including a polymer material foam core (referred to hereinafter as a foam core) and one or more facer materials coupled thereto. For example, the foam core may include a first facer coupled to a top surface and/or may include a second facer coupled to a bottom surface. In one embodiment, the facer materials include: paper, scrim, foil, fiber mats, glass mat, coated fiber or glass mats, and the like. In other embodiments, the facer materials include a combination of these materials, such as scrim, foil, and paper or fiber mat layers. The facers may vary in thickness depending on need, desired composition, availability of supplies, and the like. In one embodiment, the facer thickness varies between about 0.01 and 0.10 inches, 0.02 and 0.05 inches, and more commonly is about 0.025 inches. The various components of the pallet can be coupled together via adhesives or some other coupling mechanism, such as mechanical fasteners. According to one embodiment, the various components may be coupled via hot melt, such as a 2 part urethane, asphalt based type of adhesive. In other embodiment, relatively wide staples, plastic screws, tooted nails, and the like could be used to couple the components.

In a specific embodiment, each component of the pallets includes a foam member (i.e., the top deck, blocks, stringer, and/or bottom deck). In some embodiments, the top deck and/or bottom deck include high density foam boards. The high density top and/or bottom deck may be adhered to low density foam blocks, spacers, or stringers. In one embodiment, the high density foam boards may have a density of 2.5 pounds per cubic foot or more, such as between about 2.5 and 25 pounds per cubic foot, 2.5 and 15 pounds per cubic foot, 2.5 and 10 pounds per cubic foot, and the like. In a specific embodiment, the high density foam board range in density between about 3 and about 6 pounds per cubic foot, and more commonly about 5 pounds per cubic foot. The high density foam boards may also have a thickness of 0.08 inches or more, such as between about 0.125 inches and 2 inches, 0.125 inches and 1 inch, 0.125 inches and 0.75 inches, 0.20 inches and 0.50 inches, and more commonly about 0.250 inches.

Similarly, in one embodiment, the low density foam boards may have a density of 6 pounds per cubic foot or less, 4 pounds per cubic foot or less, and more commonly 2.5 pounds per cubic foot or less. For example, the low-density foam board's density may be between about 1.0 and 2.5 pounds per cubic foot, 1.4 and 2.5 pounds per cubic foot, and more commonly between about 1.6 and 1.8 pounds per cubic foot. The low density foam boards may also have a thickness of 2 inches or more, such as between about 2 and 6 inches, 2 and 4 inches, and more commonly 2.5 and 3 inches. The high or low density foam boards may include a polyisocyanurate foam core, a polyurethane foam core, a polystyrene foam core, and the like.

Dimensions of the pallets and/or positions of the blocks or stringers can vary depending on load requirements, lift access requirements, availability of board stock, and the like. In one embodiment, the pallet dimensions may range from 3 feet wide by 5 feet long, 4 feet wide by 8 feet long, or greater depending on the pallet requirements. In one embodiment, the low and/or high density foam boards are cut from board stock. Such pallets may be an ideal way to utilize off specification product that may otherwise end up in a land fill. In another embodiment, the foam boards and resulting pallets can be constructed from foam composite materials specially designed for use in the construction of pallets.

In one embodiment, eight or nine blocks are adhered to a top and/or bottom deck of a pallet. The blocks may be of various size depending on load requirements, lift access requirements, availability of board stock, and the like. According to one embodiment the blocks may be 6 inches wide by 8 inches long, 6 inches wide by 12 inches long, and the like. In another embodiment, ten or twelve blocks may be used of various size, such as 6 inches wide by 6 inches long. In yet other embodiments, stringers or longitudinal beams may be used for the pallet, which may be various sized depending on the pallets requirements.

The resulting foam members are typically lightweight yet strong materials that are durable and provide easy transport of various materials placed thereon. In one embodiment, the blocks or stringers are arranged to allow forks of a motorized or manual forklift, pallet jack, front loader, or other device (referred to herein as forklift) to be inserted within a cavity of the pallet under the top deck so that the forklift may lift and transport the pallet and any materials placed thereon. In one embodiment, adjacent block or stringers are spaced about 12 inches apart or more, 12 inches apart or more, 24 inches apart or more, and the like. The spacing between adjacent blocks may depend on access needs, weight distribution on a top surface of the pallet, strength of the top deck, and the like.

The pallets described herein may be configured to transport various materials. In a specific embodiment, the pallets may be used to transport other foam products, which may also be faced with one or more materials. For example, roofing cover boards, roofing panel composites, ceiling panels, and the like may be transported via the pallets described herein. To secure such goods or materials atop the pallets, one or more straps or wraps may be inserted over the goods or material and under the top deck of the pallet as known in the art. These and other aspects of the pallets will be more evident with references to the figures.

FIG. 1 illustrates a foam board 100 that is representative of a high or low density foam board that may be used for the top deck of a pallet, the bottom deck of a pallet, a stringer of the pallet, a block or spacer of the pallets, and/or any other component of the pallet. Foam board 100 includes a foam core or foam core layer 102, which material may be made of various high or low density polymer or predominantly polymer materials including: a high-density polyisocyanurate, polyurethane, polystyrene, or phenolic material or a high or low density material made of a blend of these materials. Foam board 100 may include a high-density foam material or a low density foam material depending on the need and/or application of the material. For example, when used as a top or bottom deck, foam board 100 may include a high-density foam, and when used as a stringer or block, foam board 100 may include a low-density foam.

In one embodiment, an organic or inorganic filler may be used with one of these materials or a blend of these materials. For example, 40% of the organic or inorganic filler may be added to foam core layer 102 by weight, although between about 1% and about 25% by weight of the organic and/or inorganic filler(s) is more common. Examples of various fillers that may be used in the predominantly polymer materials of the foam core 102 include but are not limited to powdered, liquid, fiber fillers, limestone (CaC03), fiberglass, recycled polyisocyanurate dust, extenders/plasticizers, ground up foam insulation, ground up rubber, wood dust, and the like. The foam core layer 102 may also include various fiber reinforcements, fungi growth-inhibiting agents, and fire-retardants to reduce the cost of and/or modify the properties of the foam core layer 102, such as but not limited to compressive strength, toughness, flexibility, friability, and fire resistance of the foam core layer 102.

As described herein, in one embodiment, foam board 100 represents a high-density foam board, such as when foam board 100 is used as a top or bottom deck of a pallet. In such embodiments, foam core layer 102 has a density of at least 2.5 lbs/ft$^3$ and preferably, between 2.5 lbs/ft$^3$ and 25 lbs/ft$^3$, 2.5 lbs/ft$^3$ and 15 lbs/ft$^3$, 2.5 lbs/ft$^3$ and 10 lbs/ft$^3$, and the like. In a specific embodiment, high-density foam board 100 ranges between about 3 lbs/ft$^3$ and about 6 lbs/ft$^3$, and more commonly about 5 lbs/ft$^3$. High-density foam board 100 has a thickness of about 0.08 inches or greater and, preferably, a thickness of 0.08 inches or more, such as between about 0.125 inches and 2 inches, 0.125 inches and 1 inch, 0.125 inches and 0.75 inches, 0.20 inches and 0.50 inches, and more commonly about 0.250 inches. The density and thickness of the high-density foam core 102 may be selected to provide the foam board 100 with the compressive strength to resist deformation when a good or other object is placed thereon and/or for other desired properties.

As described herein, in other embodiments, foam board 100 represents a low-density foam board, such as when foam board 100 is used as a stringer, block, or spacer for a pallet. In such embodiments, foam core layer 102 has a density of 6 lbs/ft$^3$ or less, and preferably, between 1.0 lbs/ft$^3$ and 2.5 lbs/ft$^3$, 1.4 lbs/ft$^3$ and 2.5 lbs/ft$^3$, and more commonly between about 1.6 lbs/ft$^3$ and 1.8 lbs/ft$^3$. Low-density foam board 100 has a thickness of about 2.0 inches or greater and, preferably, a thickness of between about 2 and 5 inches, 2 and 4 inches, and more commonly 2.5 and 3 inches. The density and thickness of the low-density foam core 102 may be selected to provide foam board 100 with various desired properties, such as compressive strength.

The low and high-density foam cores may be coupled together via adhesives and the like to form the pallets described herein. In other embodiments, the high and/or low-density foam boards 100 may also include a top facer or facer material 104 that is applied to a top surface of the respective foam cores 102. The high and/or low-density foam boards 100 may further include a bottom facer or facer material 106 that is applied to a bottom surface of the respective foam cores 102 so that the foam cores are sandwiched between two facer materials. The top and/or bottom facer materials, 104 and 106, may be any sheet material that provides a suitable major surface for the foam board 100, such as but not limited to coated or uncoated paper, foil, coated or uncoated woven or nonwoven mats made of fiberglass or other fibers or filaments, scrims, and the like, or any combination thereof. In one embodiment, top and/or bottom facer, 104 and 106, is a nonwoven fiberglass mat that is coated with a mineral or other coating such as but not limited to a calcium carbonate/clay/SBR latex coating.

The thickness of the top and/or bottom facers, 104 and 106, may vary between about 0.01 and 0.10 inches, 0.02 and 0.05 inches, and more commonly may be about 0.025 inches. The facers may be coupled with the foam core 102 so as to substantially cover the entire top or bottom surface. The facer materials used for foam board 100 may depend on various needs and/or pallet requirements. For example, a top facer 104 may be configured to provide various strength or abrasion resistance properties. Similarly, a bottom facer 106 may be selected and used to facilitate in coupling the foam board 100 with another component, material, or foam board.

It should be realized though that embodiments of the invention are not required to use top facer 104 or bottom facer 106. For example, in some embodiments, foam core 102 is directly coupled to another component, material, or foam core 102. In another embodiment, foam board 100 includes either a top facer 104 or a bottom facer 106, but not both. Various combinations of the foam core 102, top facer 104, and bottom facer 106 may be used. It should also be realized that top facer 104 and/or bottom facer 106 may include various facer material layers, such as including a foil, scrim, and paper or fiber mat layer. Additional information on exemplary foam boards that may be used for any of the embodiments described herein are provided in U.S. Pat. No. 8,105,685 filed Feb. 10, 2010 and U.S. Pat. No. 7,811,663 filed Sep. 11, 2006, the entire disclosures of which are incorporated herein by reference.

Figure 2:
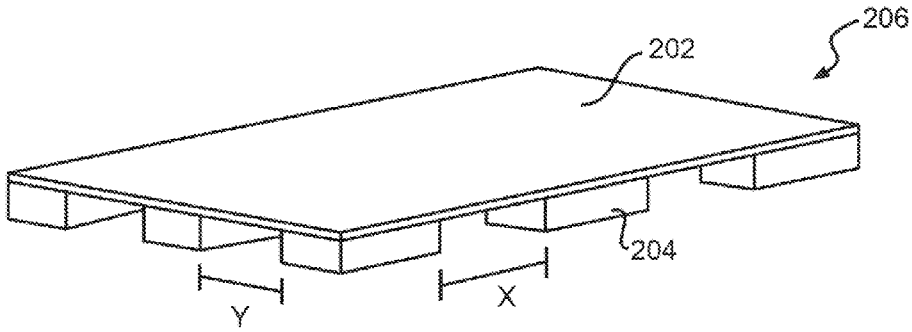
FIGS. 2-5 illustrate various pallet configurations according to embodiments of the invention.

Referring now to FIG. 2, illustrated is an embodiment of a pallet 200 having a top deck 202 coupled with a plurality of blocks or spacers 204. Top deck 202 includes a top surface that provides a roughly flat surface upon which one or more goods, materials, or other objects are placed and supported. Top deck 202 also includes a bottom surface that the plurality of blocks 204 are coupled with via adhesive bonding, and the like. The blocks 204 and bottom surface of top deck 202 may also or alternatively be coupled via hot melt, staples, plastic screws, tooted nails, and the like.

Top deck 202 may be a foam board having a foam core, or, in another embodiment, top deck 202 may be a composite board having a foam core and one or more facers coupled therewith as previously described. In one embodiment, top deck 202 includes a high-density foam core material having a three foot by five foot rectangular board configuration, or a four foot by eight foot rectangular board configuration, so as to form a pallet 200 having those configurations. Top deck 202 may include various other rectangular board or other shape configurations depending on the desired pallet shape. Top deck 202 may also include any of the density and/or board thickness configurations described herein, such as, for example, a foam density of about 5.0 lbs/ft$^3$ and a thickness of about 0.25 inches.

The plurality of blocks 204 may support the top deck 202 above the ground and may be arranged to allow forks of a fork lift to be positioned under the bottom surface of top deck 202 so that pallet 200 may be lifted and transported via the forklift. Blocks 204 may likewise have a foam core, or be a composite material having a foam core and one or more facers coupled therewith as previously described. In one embodiment, blocks 204 include a low-density foam core material having a six inch by eight inch rectangular configuration, or a six inch by 12 inch rectangular configuration. Blocks 204 may include various other configurations depending on the desired height of the top deck 202 above the ground, the size of the forklift forks, and/or other needs. Blocks 204 may also include any of the density and/or block thickness configurations described herein, such as, for example, a foam density of between 1.6 and 1.8 lbs/ft$^3$ and a thickness of between 2.5 and 6 inches.

In one embodiment, top deck 202 and each of the blocks 204 are composite materials having a foam core and at least one facer coupled therewith, which may be coupled on the top or bottom surface of the foam core as described herein. In a specific embodiment, top deck 202 and/or each of the blocks 204 include both a top facer and a bottom facer with the foam core sandwiched there between.

Pallet 200 may include eight or nine blocks 204 that are coupled with the bottom surface of top deck 202 in columns and rows. This configuration may include an internally arranged block, or a block disposed near the center of top deck 202. This configuration allows the forks of a forklift to be inserted partially or fully underneath top deck 202 so that pallet 200 may be lifted and transported to one or more areas, or loaded within a shipping truck or container. Blocks 204 may be arranged so that a spacing X between longitudinally adjacent blocks is about 12 inches or more, 18 inches or more, 24 inches or more, and the like. Similarly, a lateral spacing Y between adjacent blocks may be about 12 inches or more, 18 inches or more, 24 inches or more, and the like depending on the various requirements of pallet 200.

The size and or spacing of block 204 may be varied depending on the type of fork lift access required and/or load rating for the pallet 200. According to one embodiment, low density polyISO foam (e.g., about 1.6 lb/ft$^2$) having a compressive strength of around 20 psi may be used for the blocks 204. Nine 6 inch by 9 inch spacer blocks 204 may be evenly distributed with respect to pallet 200 to allow the pallet to hold approximately 9720 lbs. It should be realized, however, that the foam density and block 204 size and spacing dictate the load capacity of pallet 2000 may be designed based on the pallet's requirements. For example, lower density blocks 204 covering more surface area may be able to handle point loads better than smaller, higher density foam spacers. It may be advisable to minimize point loads, which puncture or fracture top deck 202 or a bottom deck of the pallet. The flexibility of the top deck 202 and/or bottom deck boards and the spacing and/or arrangement of the blocks 204 should be considered in designing the pallet 200 so as to minimize point loads.

Figure 3:
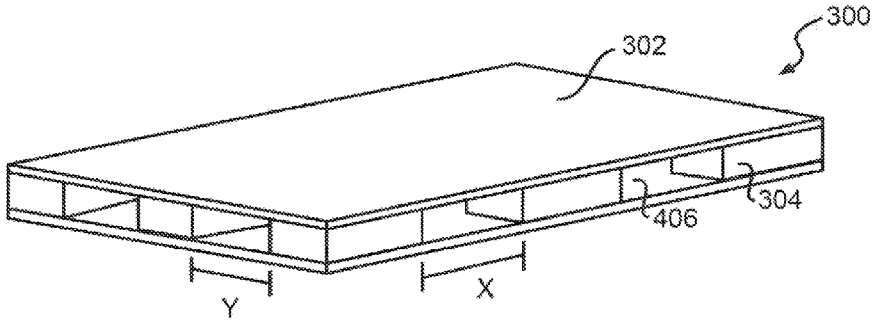

Referring now to FIG. 3, illustrated is another embodiment of a pallet 300 that includes a top deck 302, a plurality of blocks or spacers 304 coupled with a bottom surface of the top deck 302 and a bottom deck 306 coupled with a bottom surface of the blocks 304. The spacing and other dimensions or configurations of pallet 300, top deck 302, blocks 304, spacing X and/or Y, and bottom deck 306 may be similar to pallet 200. For example, top deck 302 and bottom deck 306 may be separated depending on the thickness of blocks 304 (e.g., 2-6 inches), which may allow forks of a forklift to easily fit between the decks and adjacent blocks so that pallet 300 may be lifted and transported. Bottom deck 306 may provide a relatively flat bottom surface that may facilitate in storage and/or transport of pallet 300, such as by enabling vertical stacking of multiple pallets.

The bottom deck 306 may include a high-density foam core material that may or may not be coupled with top or bottom facers. In one embodiment, top and bottom decks, 302 and 306, include a high-density foam while one or more of the block 304 include a low-density foam. In a specific embodiment, the top and bottom decks, 302 and 306, and one or more blocks 304 also include at least one facer and are preferably sandwiched between top and bottom facers.

The top deck 302 and bottom deck 306 may also have similar configurations, such as by each having a foam core layer and one or more facers coupled therewith, or, in another embodiment, may have different configurations, such as one deck having a foam core layer without a facer and the other being a composite structure having a foam core and one or more facers. In yet another embodiment, either top deck 302 or bottom deck 306 may include a different material altogether, such as one of the decks not including a foam core material.

Figure 4:
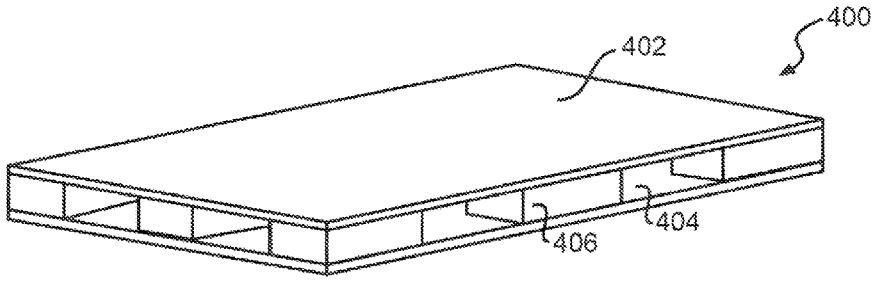

Referring now to FIG. 4, illustrated is another embodiment of a pallet 400 having a top deck 402, a plurality of blocks or spacers 404 coupled with a bottom surface of the top deck 402 and a bottom deck 406 coupled with a bottom surface of the blocks 404. Pallet 400 includes more blocks or spacers 404 than those shown in the previous figures. In one embodiment, pallet 400 includes between ten and twelve blocks, which may include a pair of internally arranged blocks. Blocks 404 may have a roughly square or rectangular configuration. For example, blocks 404 may be six inch by six inch squares, eight inch by eight inch squares, and the like, and may have a thickness or height of between about two and six inches as previously described. In other embodiments, blocks 404 are roughly rectangular in shape, such as six inch by eight inch rectangles and the like. This configuration may allow forks of a forklift to be inserted in two different locations longitudinally.

The spacing and/or other dimensions or configurations of pallet 400, top deck 402, blocks 404, and bottom deck 406 may be similar to pallets 200 and/or 300. Similarly, like pallet 300, bottom deck 406 may provide a relatively flat bottom surface that may facilitate in storage and/or transport of pallet 400, such as by enabling vertical stacking of multiple pallets.

Figure 5:
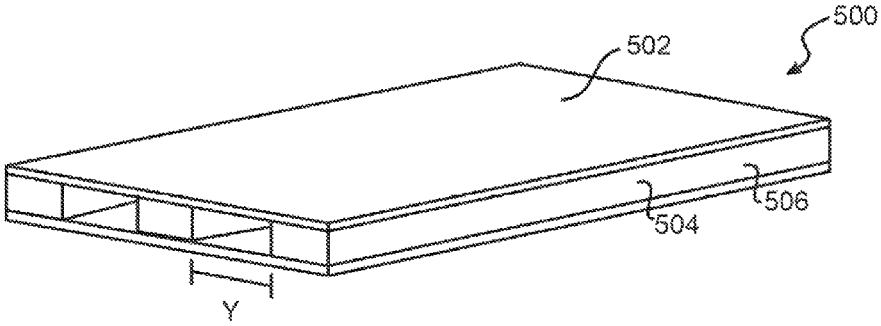

Referring now to FIG. 5, illustrated is another embodiment of a pallet 500 having a top deck 502 and a bottom deck 506. Top deck 502 and/or bottom deck 506 may be configured similar to any of the decks or foam boards described herein. Disposed between and coupled with top deck 502 and bottom deck 506 is a plurality of stringers or longitudinal beams 504. The stringers 504 may extend along a portion or the entire longitudinal length of pallet 500 so that forklift access to the pallet 500 is limited to the opposing ends. In the embodiment shown, pallet 500 includes three stringers 504, although more or fewer than this may be used depending on the pallet requirements and/or other needs.

In one embodiment, the stringers 504 may be approximately six or eight inches wide and approximately equivalent to the longitudinal length of the pallet, such as five or eight feet long. The stringers 504 may also be between two and six inches thick as previously described depending on the forklift dimensions and/or other needs. The stringers 504 may also be arranged to provide a spacing X of 12 inches or more, 18 inches or more, 24 inches or more, and the like.

In one embodiment, top and bottom decks, 502 and 506, include a high-density foam while one or more of the stringers 504 include a low-density foam. In a specific embodiment, the top and bottom decks, 502 and 506, and one or more blocks 504 also include at least one facer and are preferably sandwiched between top and bottom facers.

Figure 6:
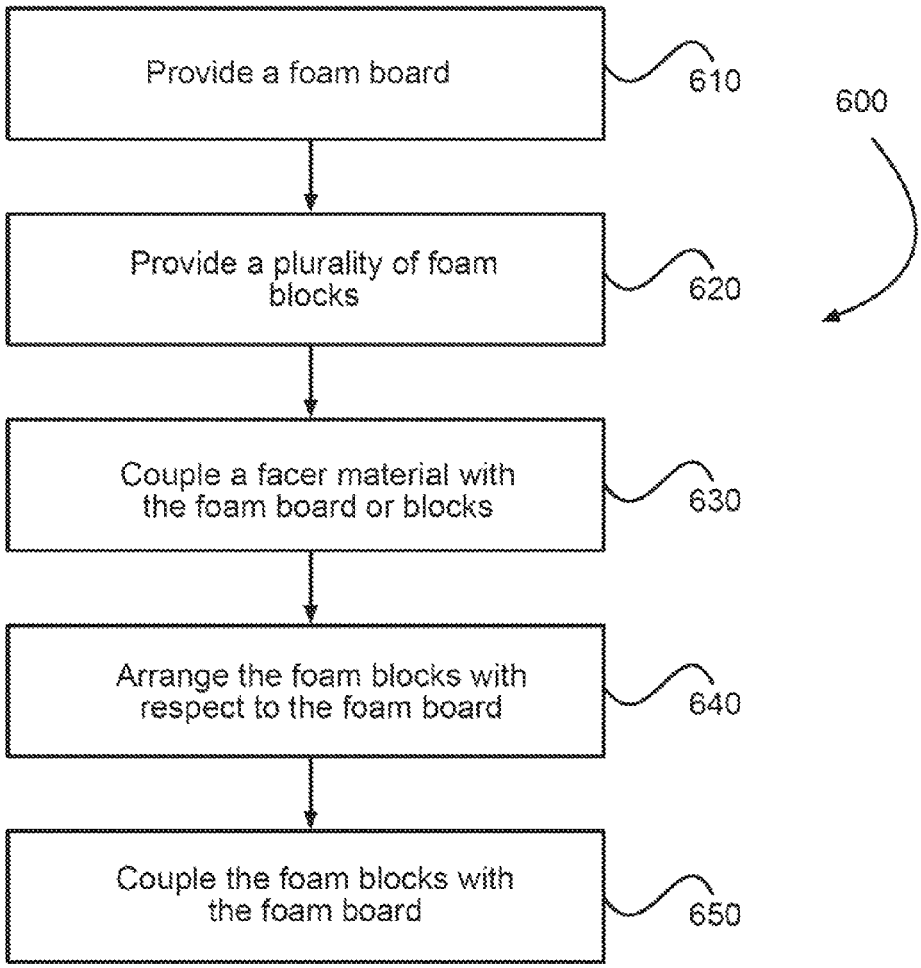
FIG. 6 illustrates a method of constructing a pallet according to an embodiment of the invention.

Referring now to FIG. 6, illustrated is another embodiment of a pallet 600 having a top deck 602 and a plurality of blocks or spacers 604 coupled therewith as described herein. The blocks 604 may have any of the size, spacing, and/or arrangement configurations described herein.

Pallet 600 also includes a plurality of bottom strips 606 coupled with the bottom surface of blocks 604. Bottom strips 606 may be composite materials having a foam core and at least one facer coupled therewith as described herein. In a specific embodiment, bottom strips 606 include both a top facer and a bottom facer with the foam core sandwiched there between. Strips 606 may be cut to an appropriate width and/or length from a top deck 602 or bottom deck board. According to one embodiment, strips 606 may have a width approximately equal to the blocks 604 and a length sufficient to traverse pallet 600. As shown, each strip 606 spans and is coupled with multiple blocks 604. Strips 606 may be arranged longitudinally and/or transversely with respect to top deck 602 and blocks 604.

The pallet 600 configuration shown in FIG. 6 may enable use with pallet jacks, which include front wheels mounted inside the ends of the forks that push against the floor and separate vertically from the forks to lift a pallet clear of the floor. Due to this functionality, pallet jacks may be difficult to use with several of the embodiments previously described because these embodiments include a solid bottom deck surface. Strips 606 also help to hold blocks 604 in place if and/or when pallet 600 is dragged across a floor or other surface by reinforcing the blocks 604. Thus, strips 606 may also function to prevent decoupling of the blocks 604 from top deck 602, which may occur in some situations when a pallet does not include a bottom deck or strips. In some embodiments, holes may be cut in the bottom deck surface of the pallets shown in FIGS. 3-5 to enable the pallets to be used with pallet jacks. The wheels of the pallet jacks may be positioned in the holes to allow the pallet to be lifted above the ground.

Referring now to FIG. 7, illustrated is a method 700 of constructing a pallet. At block 710, a foam board, or top deck, is provided having a top surface and a bottom surface. As described herein, the top surface is configured to support one or more goods, materials, or other objects placed thereon. At block 720, a plurality of foam blocks are provided. At block 730, a facer material is coupled with the foam board and/or one or more of the plurality of foam blocks. In one embodiment, a facer material is coupled with the top surface or bottom surface of the foam board and an additional facer material is coupled with a top surface or a bottom surface of each foam block. In another embodiment, a top facer material is coupled with the top surface of the foam board and a bottom facer material is coupled with the bottom surface of the foam board. Similarly, a top facer material may be coupled with the top surface of each foam block and a bottom facer material may be coupled with the bottom surface of each foam block.

At block 740, the plurality of foam blocks are arranged with respect to the bottom surface of the foam board so that a spacing between adjacent foam blocks is wider than the width of a fork of a forklift. At block 750, the plurality of foam blocks are coupled with the bottom surface of the foam board so that the foam board is supported above the ground when placed thereon.

The method may also include providing an additional foam board, or bottom deck, having a top surface and a bottom surface and coupling the plurality of foam blocks with the top surface of the additional foam board or bottom deck such that the foam blocks are disposed between the foam board or top deck and the additional foam board or bottom deck. A facer material may also be coupled with the additional foam board or bottom deck. According to one embodiment, adhesive bonding may be used to couple the plurality of foam blocks with the bottom surface of the foam board or top deck and/or top surface of the additional foam board or bottom deck. The foam boards, foam blocks, resulting pallets, and the like may have the various dimensions and/or configurations described herein.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A pallet comprising:

a composite board having a top surface and a bottom surface, the top surface being configured to provide a roughly flat surface to support one or more goods or other objects placed thereon, the composite board comprising:

a foam core, the foam core of the composite board having a first foam density; and a facer material coupled with a top surface or a bottom surface of the foam core; and a plurality of composite blocks coupled with the bottom surface of the composite board to support the composite board above the ground, the plurality of composite blocks being arranged with respect to the bottom surface to allow forks of a fork lift to be positioned under the bottom surface of the composite board such that the pallet is transportable via the forklift, wherein at least one of the composite blocks comprise:

a foam core, the foam core of the composite blocks having a second foam density that is less than the first foam density; and a facer material coupled with a top surface or a bottom surface of the foam core.

2. The pallet of claim 1, wherein the composite board comprises a top deck, and wherein the pallet further comprises a bottom deck having a top surface and a bottom surface, wherein the plurality of composite blocks are coupled with the top surface of the bottom deck, and wherein the bottom deck comprises:

a foam core; and a facer material coupled therewith.

3. The pallet of claim 1, wherein the facer material comprises a first facer material coupled with the top surface of the foam core, and wherein the composite board further comprises a second facer material coupled with the bottom surface of the foam core such that the foam core is sandwiched between the first facer material and the second facer material, wherein the first or second facer materials comprise a non-woven fiberglass mat having a mineral coating.

4. The pallet of claim 1, wherein the at least one of the composite blocks further comprises an additional facer material coupled with the top surface or the bottom surface of the foam core such that the foam core is disposed between the facer material and the additional facer material.

5. The pallet of claim 1, wherein the foam core of the composite board comprises a foam density of between about 2.5 and about 25 pounds per cubic foot, and wherein the foam core of the plurality of composite blocks comprises a foam density of between about 1.5 and about 2.5 pounds per cubic foot.

6. The pallet of claim 1, further comprising at least one composite board strip coupled with a bottom surface of at least two composite blocks such that the at least two composite blocks are sandwiched between the at least one composite board strip and the composite board.

7. The pallet of claim 1, wherein the facer material of the composite board or the at least one of the composite blocks comprises a material selected from:

paper;

coated paper;

foil;

fiber mat;

coated fiber mat;

glass mat;

coated glass mat; or scrim.

8. A pallet comprising:

a foam board having a first foam density, the foam board having a top surface and a bottom surface, the top surface being configured to support one or more goods or other objects placed thereon; and a plurality of foam blocks having a second foam density that is less than the first foam density, the plurality of foam blocks being coupled with the bottom surface of the foam board to support the foam board above the ground, and the plurality of foam blocks being arranged with respect to the bottom surface to allow forks of a fork lift to be positioned under the foam board such that the pallet is transportable via the forklift.

9. The pallet of claim 8, further comprising:

a facer material coupled with the foam board or with at least one of the plurality of foam blocks.

10. The pallet of claim 8, wherein the foam board comprises:

a foam core;

a first facer material coupled with a top surface of the foam core, the first facer material being configured to provide abrasion resistance; and a second facer material coupled with a bottom surface of the foam core such that the foam core is sandwiched between the first facer material and the second facer material, the second facer material being configured to facilitate coupling of the foam board with another component.

11. The pallet of claim 8, wherein each foam block comprises:

a foam core;

a first facer material coupled with a top surface of the foam core; and a second facer material coupled with a bottom surface of the foam core.

12. The pallet of claim 8, wherein the foam board comprises a top deck, and wherein the pallet further comprises a bottom deck having a top surface and a bottom surface, wherein the plurality of foam blocks are coupled with the top surface of the bottom deck.

13. The pallet of claim 8, wherein the foam board comprises a top deck, and wherein the pallet further comprises a plurality of foam board strips each having a top surface and a bottom surface, wherein each foam board strip is coupled with at least two foam blocks such that the foam blocks are sandwiched between the top deck and a respective foam board strip.

14. The pallet of claim 12, wherein the bottom deck comprises:

a foam core; and a facer material coupled therewith.

15. The pallet of claim 8, wherein the foam board comprises a foam density of between about 2.5 and about 25 pounds per cubic foot, and wherein each foam block comprises a foam density of between about 1.5 and about 2.5 pounds per cubic foot.

16. The pallet of claim 15, wherein the foam board comprises a foam density of between about 4.0 and about 7.0 pounds per cubic foot, and wherein each foam block comprises a foam density of between about 1.6 and about 2.0 pounds per cubic foot.

17. The pallet of claim 8, wherein the pallet comprises at least 8 foam blocks.

18. A method of constructing a pallet comprising:

providing a foam board having a first foam density, the foam board having a top surface and a bottom surface, the top surface being configured to support one or more goods or other objects placed thereon;

providing a plurality of foam blocks, the foam blocks having a second foam density that is less than the first foam density;

coupling a facer material with the foam board or one or more of the plurality of foam blocks;

arranging the plurality of foam blocks with respect to the bottom surface of the foam board so that a spacing between adjacent foam blocks is wider than the width of a fork of a fork lift; and coupling the plurality of foam blocks with the bottom surface of the foam board such that the foam board is supported above the ground.

19. The method of claim 18, further comprising:

coupling a facer material with the top surface or the bottom surface of the foam board; and coupling an additional facer material with a top surface or a bottom surface of each foam block.

20. The method of claim 18, further comprising:

providing an additional foam board having a top surface and a bottom surface; and coupling the plurality of foam blocks with the top surface of the additional foam board such that the foam blocks are disposed between the foam board and the additional foam board.

21. The method of claim 20, further comprising coupling a facer material with the additional foam board.

22. The method of claim 18, wherein coupling the plurality of foam blocks with the bottom surface of the foam board comprises adhesive bonding.

* * * * *